United States Patent [19]

McDonie et al.

[11] Patent Number: 4,593,229

[45] Date of Patent: Jun. 3, 1986

[54] SHIELD CUP TO CAGE ASSEMBLY CONNECTING TAB MEMBER FOR PHOTOMULTIPLIER TUBE

[75] Inventors: Arthur F. McDonie; Donald B. Kaiser, both of Lancaster, Pa.

[73] Assignee: RCA Corporation, Princeton, N.J.

[21] Appl. No.: 611,873

[22] Filed: May 18, 1984

[51] Int. Cl.[4] ..... H01J 40/04; H01J 43/06

[52] U.S. Cl. ..... 313/533; 313/536; 313/261

[58] Field of Search ..... 313/536, 533, 532, 535, 313/261

[56] References Cited

U.S. PATENT DOCUMENTS

| | | | |
|---|---|---|---|
| Re. 30,249 | 4/1980 | Faulkner | 313/104 |
| 2,396,170 | 3/1946 | Fulton, Jr. | 313/261 X |
| 2,862,135 | 11/1958 | Payne | 313/261 X |
| 2,942,137 | 6/1960 | Taylor | 313/261 X |
| 4,370,585 | 1/1983 | Butterwick . | |
| 4,426,596 | 1/1984 | Butterwick | 313/534 |
| 4,431,943 | 2/1984 | Faulkner et al. | 313/533 |

OTHER PUBLICATIONS

U.S. patent application entitled, "Photomultiplier Tube Having an Electron Multiplier Cage Assembly with Uniform Transverse Spacing", by A. F. McDonie et al., (filed concurrently herewith), Ser. No. 611,753.

U.S. patent application entitled, "Electrode Structure for an Electron Multiplier Cage Assembly", by D. B. Kaiser, filed concurrently herewith-Ser. No. 611,754.

U.S. patent application entitled, "Photomultiplier Tube Having an Improved Centering and Cathode Contacting Structure", by D. B. Kaiser, filed concurrently herewith-Serial No. 611,958.

*Primary Examiner*—Palmer C. DeMeo

*Attorney, Agent, or Firm*—Eugene M. Whitacre; Dennis H. Irlbeck; Vincent J. Coughlin, Jr.

[57] ABSTRACT

A photomultiplier tube comprises an evacuated envelope having a photoemissive cathode, a shield cup spaced from the cathode and an electron multiplier cage assembly abutting the shield cup. The cage assembly includes a pair of transversely spaced insulating support plates having oppositely disposed surfaces. A plurality of dynodes and an anode are disposed between the support plates. A plurality of oppositely disposed locating slots are formed in the shield cup. At least one tab slot is formed through the oppositely disposed surfaces of each of the support plates. A plurality of connecting tab members are provided for connecting the cage assembly to the shield cup. Each tab member includes a slot engaging portion, a locking portion, a locating portion and an attachment portion. The slot engaging portion is disposed within the tab slot of the support plate. The locking portion extends from one end of the slot engaging portion for securely engaging one surface of the plate. A locating portion extends from the other end of the slot engaging portion along the other oppositely disposed surface of the plate and through one of the locating slots formed in the shield cup. The attachment portion of the tab member is fixedly attached to the shield cup.

6 Claims, 10 Drawing Figures

SHIELD CUP TO CAGE ASSEMBLY CONNECTING TAB MEMBER FOR PHOTOMULTIPLIER TUBE

BACKGROUND OF THE INVENTION

The present invention relates to photomultiplier tubes and, more particularly, to a photomultiplier tube in which a cage assembly is accurately and expeditiously positioned relative to a shield cup.

In the manufacturing of a high volume photomultiplier tube, conflicting objectives are frequently encountered. The tube must be designed to provide accurate and reproducible measurement of the phenomenon being observed, and yet, the tube must be inexpensive to produce. The former objectives demand that the position of each element of the tube be fixed accurately with respect to the other tube elements; however, this must be done without the use of a large number of expensive precision parts. In order to achieve the latter objective, the tube must be easy to assemble in order to eliminate the need for difficult, time consuming assembly techniques.

U.S. Pat. No. 4,370,585, issued to G. N. Butterwick on Jan. 25, 1983, shows a dynode assembly attached to a shield by means of a primary dynode and a plurality of interconnected tube elements which, when welded together, affix the shield to the dynode assembly. In the patented structure, the primary dynode is attached to the shield; however, in many tubes, it is desirable to operate the shield at a potential different from that applied to the primary dynode. In such a structure, such a mode of interconnection between the shield and the dynode assembly is nonavailing since the primary dynode must be isolated from the shield.

U.S. Pat. No. 4,426,596, issued to G. N. Butterwick on Jan. 17, 1984, shows a photomultiplier tube which utilizes a conventional structure for attaching a cage assembly to a shield cup. A pair of support rods extend through apertures in the dynode support spacers adjacent to the interface between the spacers and the shield cup. A pair of wire brackets are welded at the ends to the ends of the support rods extending through the apertures in the support spacers. The center portions of the wire brackets are shaped to conform to the bottom surface of the shield cup and are welded thereto to attach the cage assembly to the shield cup. The described structure requires a great deal of welding and tends to stress and distort the parts.

U.S. Pat. No. 4,431,943, issued to R. D. Faulkner et al. on Feb. 14, 1984, discloses a photomultiplier tube having an electron multiplier attached to a cup-shaped field forming electrode. In this structure, dynode support insulators extend through the bottom surface of the electrode and are locked in place by means of welded tabs and support rods extending through apertures in one side of the insulators, similar to those described in U.S. Pat. No. 4,426,596 to Butterwick, referenced above. In addition, locking slots are formed in the other side of the insulators to engage the bottom surface of the electrode. A great many parts are needed to affix the cage assembly to the electrode, and the assembly is complex and costly.

SUMMARY OF THE INVENTION

A photomultiplier tube comprises an evacuated envelope having a photoemissive cathode, a shield cup spaced from the cathode and an electron multiplier cage assembly abutting the shield cup. The cage assembly includes a pair of transversely spaced insulating support plates having oppositely disposed surfaces. A plurality of dynodes and an anode are disposed between the support plates. A plurality of oppositely disposed locating slots are formed in the shield cup. At least one tab slot is formed through the oppositely disposed surfaces of each of the support plates. A plurality of connecting tab members are provided for connecting the cage assembly to the shield cup. Each tab member includes a slot engaging portion, a locking portion, a locating portion and an attachment portion. The slot engaging portion is disposed within the tab slot of the support plate. The locking portion extends from one end of the slot engaging portion for securely engaging one surface of the plate. A locating portion extends from the other end of the slot engaging portion along the other oppositely disposed surface of the plate and through one of the locating slots formed in the shield cup. The attachment portion of the tab member is fixedly attached to the shield cup.

DETAILED DESCRIPTION OF THE PREFERRED EMBODIMENT

Figure 1:
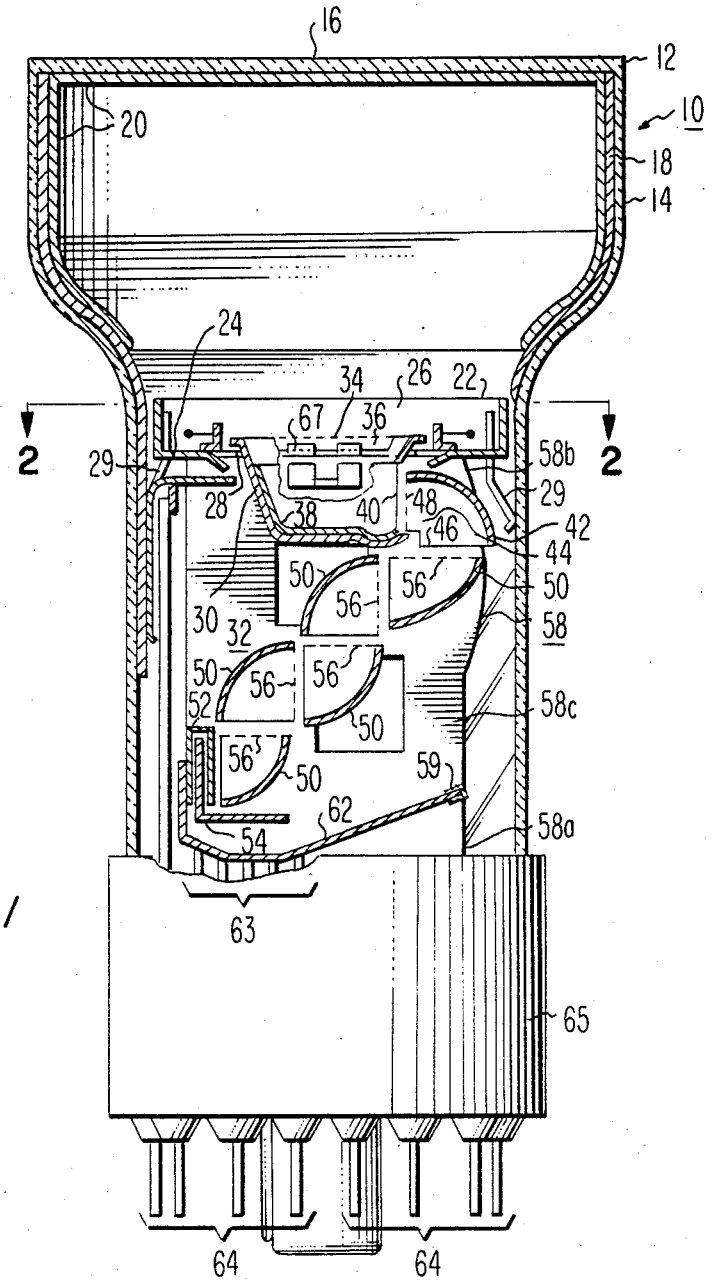
FIG. 1 is a sectional view partially broken away of a photomultiplier tube embodying the present invention.

A photomultiplier tube 10, shown in FIG. 1, comprises an evacuated envelope 12 having a sidewall 14. The envelope 12 is closed at one end by a transparent faceplate 16 and at the other end by a stem portion (not shown). A conductive layer 18 is vapor deposited on a portion of the sidewall 14 adjacent to the faceplate 16. A photoemissive cathode 20 is formed on the interior surface of the faceplate 16 and also along a portion of the conductive layer 18 on the sidewall 14. The photoemissive cathode 20 may comprise any of the alkali-antimonide materials known in the art. The photoemissive cathode 20 emits photoelectrons in response to radiation incident thereon.

A shield cup 22 is provided in spaced relation to the photoemissive cathode 20. The shield cup 22 is a cup-shaped field forming electrode having a substantially flat base portion 24 and an annular wall portion 26 disposed perpendicular to the base portion 24. A centrally disposed, substantially rectangular aperture 28 extends through the base portion 24 of the shield cup 22. The shield cup 22 is centered within the envelope 12 by a plurality of bulb spacers 29. A primary dynode 30 is disposed within the aperture 28 and is spaced therefrom. The primary dynode 30 has a cross-sectional contour substantially identical to that described in U.S. Reissue Pat. No. 30,249, issued to R. D. Faulkner on Apr. 1, 1980, and comprises the first electrode of an electron multiplier cage assembly 32. A substantially flat primary field mesh member 34 is affixed to an input aperture 36 of the primary dynode 30. The primary dynode 30 preferably comprises a nickel substrate with an alkali-antimonide secondary emission coating 38 formed thereon. Alternatively, the primary dynode may be formed of a beryllium-copper material having a beryllium-oxide secondary emissive surface. The primary dynode 30 has an output aperture 40.

The electron multiplier cage assembly 32 further includes a box-like secondary dynode 42 which acts as a receiving member for secondary electrons emitted from the secondary emission coating 38 of the primary dynode 30. The dynode 42 has an input end 44 and an output end 46. A secondary field mesh member 48 extends across the input end of the secondary dynode 42. A plurality of additional substantially-identical box-like secondary dynodes 50 are disposed between the secondary dynode 42 and an ultimate secondary dynode 52. The ultimate secondary dynode 52 encloses an anode 54. Each of the secondary dynodes 42, 50 and 52 is preferably formed of nickel and has an alkali-antimonide coating (not shown) formed on the inside surface thereof so that the dynode can propagate electron emission from the cathode 20 to the anode 54. Each of the secondary dynodes 50 includes a field mesh 56 disposed across the input end thereof. The primary dynode 30, the secondary dynodes 42, 50, 52 and the anode 54 are disposed between a pair of substantially parallel, spaced apart insulating support plates 58 (only one of which is shown in FIG. 1). The support plates 58 have a distal end 58*a*, a proximal end 58*b*, an inside surface 58*c* and an outside surface 58*d*. As shown in FIG. 1, a shield notch 59 is formed along-one side of each of the support plates 58 to accommodate a shield tab (not shown) of a light shield 62 which extends transversely between the support plates 58 and closes the lower end of the cage assembly 32. The light shield 62 includes a pair of weld tabs (not shown), which facilitate attachment of the light shield 62 to the ultimate dynode 52. Electrical connections to the photocathode 20, the dynodes 30, 42, 50, 52 and the anode 54 are provided by means of leads 63, which are attached to a plurality of pins 64 in a base 65.

Figure 2:
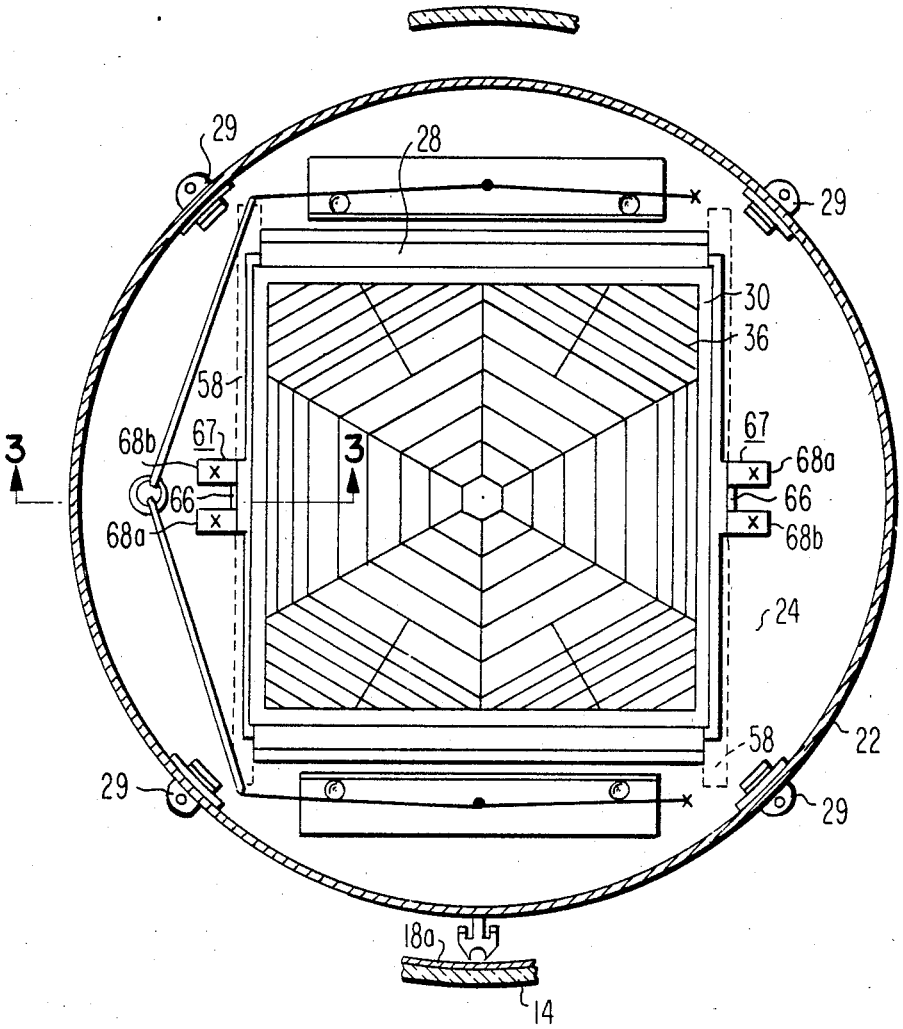
FIG. 2 is a top sectional view taken along line 2—2 of FIG. 1.

As shown in FIG. 2, a pair of oppositely disposed locating slots 66 are formed in the base, portion 24 of the shield cup 22 adjacent to the centrally disposed aperture 28. A pair of novel connecting tab members 67, having a pair of attachment tabs 68*a* and 68*b*, extend through the locating slots 66 to connect the electron multiplier cage assembly 32 to the shield cup 22. The locating slots 66 fix the relative position of the shield cup 22 and the cage assembly 32 in the lateral plane. The longitudinal positions of the shield cup 22 and the cage assembly 32 are fixed by the attachment tabs 68*a* and 68*b* of the tab members 67, which are welded to the base portion 24 of the shield cup 22.

Figure 3:
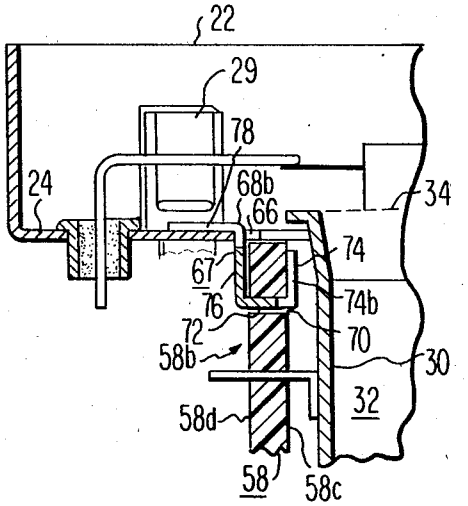
FIG. 3 is a longitudinal view taken along line 3—3 of FIG. 2.

With reference to FIG. 3, one of the novel connecting tab members 67 is shown disposed within a tab slot 70 formed through the surfaces 58*c*, 58*d* adjacent to the proximal end 58*b* of one of the support plates 58. An identical tab slot is formed in the other support plate (not shown). The connecting tab member 67 comprises four interconnected portions. A slot engaging portion 72 is disposed within the tab slot 70 of the support plate 58. A locking portion 74 extends from one end of the slot engaging portion 72. The locking portion 74 extends substantially perpendicular to the slot engaging portion 72 and securely engages the inside surface 58*c* of the support plate 58. A locating portion 76 extends from the other end of the slot engaging portion 72 and is disposed substantially perpendicular thereto along the outside surface 58*d* of the support plate 58 and through one of the locating slots 66 formed in the base portion 24 of the shield cup 22. An attachment portion 78 extends from the locating portion 76 and is substantially perpendicular thereto. The attachment portion 78 includes the aforementioned attachment tabs 68*a* and 68*b*, which are fixedly attached, for example by welding, to the base portion 24 of the shield cup 22.

Figure 4:
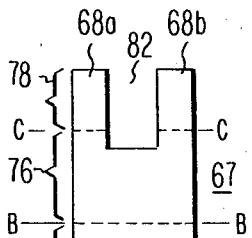
FIG. 4 is a plan view of the novel connecting tab member before forming.

A plan view of the connecting tab member 67, before forming, is shown in FIG. 4. Each of the four interconnected portions 72, 74, 76 and 78 are clearly delineated in the figure. The oppositely disposed ends of the tab member 67 are bifurcated, and the locking portion 74 includes a pair of locking tabs 74*a* and 74*b* separated by a first notch 80. The first notch 80 extends into the slot engaging portion 72. At the opposite end of the tab member 67 is the attachment portion 78, which includes the attachment tabs 68*a* and 68*b*, which are separated by a second notch 82. The second notch 82 extends into the locating portion 76.

Figure 7:
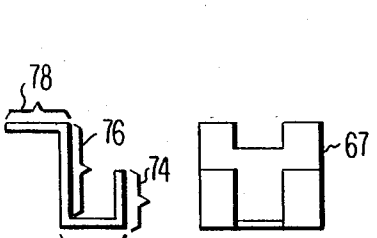
FIG. 7*a* is a side view of the tab member bent along lines A—A, B—B and C—C of FIG. 4.
FIG. 7*b* is a front view of the tab member of FIG. 7*a*.
Figure 6:
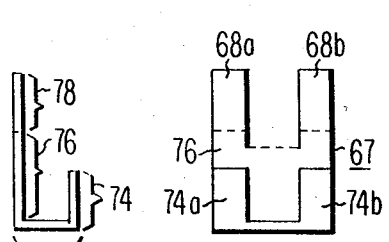
FIG. 6*a* is a side view of the tab member bent along lines A—A and lines B—B of FIG. 4.
FIG. 6*b* is a front view of the tab member of FIG. 6*a*.
Figure 5:
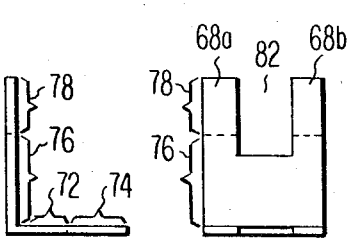
FIG. 5*a* is a side view of the tab member bent along lines B—B of FIG. 4.
FIG. 5*b* is a front view of the tab member of FIG. 5*a*.

In the joining of the shield cup 22 and the cage assembly 32, the connecting tab members 67 are first bent along line B—B of FIG. 4 to form the structure shown in FIG. 5. This tab member structure is disposed within the tab slot 70 of the support plate 58. Then, the locking portion 74 of the tab member is bent perpendicular to the slot engaging portion 72 to provide the structure shown in FIG. 6. It is the configuration shown in FIG. 6 which permits the tab member 67 to be disposed within the locating slots 66 of the shield cup 22. With the shield cup abutting the proximal ends 58*b* of the support plates 58, the attachment tabs 68*a* and 68*b*, shown in FIG. 6*b*, are bent, as shown in FIGS. 3 and 7, to contact the base portion 24 of the shield cup 22. The tab member 67 is preferably formed of stainless steel and has a thickness of about 0.25 mm (10 mils). The tab member 67 facilitates the accurate interconnection of the shield cup 22 to the cage assembly 32 with a simple, inexpensive part which requires a minimum amount of time and skill to assemble. As shown in FIG. 4, a portion of the first notch 80 of tab member 67 is included within the slot engaging portion 72 so that when the locking tabs 74*a* and 74*b* are bent to engage the inside surface 58*c* of the support plate 58, as shown in FIG. 3, the tabs 74*a* and 74*b* will deform readily and will not damage the support plate 58.

What is claimed is:

1. In a photomultiplier tube comprising an evacuated envelope having a photoemissive cathode, a shield cup spaced from said cathode and an electron multiplier cage assembly abutting said shield cup, said cage assembly including a pair of transversely spaced insulating support plates having oppositely disposed surfaces, a plurality of dynodes, and an anode disposed between said support plates, the improvement comprising a plurality of oppositely disposed locating slots formed in said shield cup, at least one tab slot formed through the oppositely disposed surfaes of each of said support plates, and a plurality of connecting tab members for attaching said support plates to said shield cup, each of said tab members having oppositely disposed bifurcated ends, one of said bifurcated ends including a locking portion for securely engaging one surface of said support plate, said locking portion comprising a pair of locking tabs separated by a first notch, the other of said oppositely disposed bifurcated ends including an attachment portion for fixedly attaching said tab member to said shield cup thereby securely interconnecting said cage assembly to said shielded cup, said attachment portion comprising a pair of attachment tabs separated by a second notch, each of said tab members further including a slot engaging portion adjacent to said locking portion and disposed within said tab slot of said support plate, and a locating portion extending from the other end of said slot engaging portion along the other oppositely disposed surface of said support plate and through one of the locating slots formed in said shield cup.

2. The tube as described in claim 1, wherein at least a portion of said first notch is disposed within said tab slot of said support plate.

3. The tube as described in claim 1, wherein said locking tabs are disposed substantially perpendicular to said slot engaging portion of said tab member.

4. The tube as described in claim 1, wherein said locating portion of said tab member extends substantially parallel to said locking portion, said locating portion including said second notch.

5. The tube as described in claim 1, wherein said attachment tabs are disposed substantially perpendicular to said locating portion of said tab member.

6. In a photomultiplier tube comprising an evacuated envelope having a photoemissive cathode for emitting photoelectrons in response to radiation incident thereon, a shield cup spaced from said cathode, said shield cup having a centrally disposed aperture, and an electron multiplier cage assembly abutting said shield cup for receiving said photoelectrons through said centrally disposed aperture, said cage assembly including a pair of transversely spaced insulating support plates, each plate having an inside surface and an outside surface, a plurality of dynodes, and an anode disposed between the inside surfaces of said plates, the improvement comprising a plurality of oppositely disposed locating slots formed in said shield cup adjacent to said centrally disposed aperture, at least one tab slot formed through the surfaces of each of said support plates adjacent to one end thereof, and a plurality of connecting tab members for attaching said plates to said shield cup, each of said tab members having oppositely disposed bifurcated ends, each of said tab members including a slot engaging portion disposed within said tab slot of said plate, a locking portion at one bifurcated end, said locking portion extending from one end of said slot engaging portion and being substantially perpendicular thereto for securely engaging the inside surface of said plate, said locking portion having a pair of locking tabs separated by a first notch, a portion of said first notch being included within said slot engaging portion, a locating portion extending from the other end of said slot engaging portion and extending perpendicular to said slot engaging portion along the outside surface of said plate and through one of the locating slots formed in said shield cup, and an attachment portion at the other bifurcated end, said attachment portion being disposed substantially perpendicular to said locating portion for fixedly attaching said tab member to said shield cup thereby securely interconnecting said cage assembly and said shield cup, said attachment portion having a pair of attachment tabs separated by a second notch.

* * * * *

UNITED STATES PATENT AND TRADEMARK OFFICE

CERTIFICATE OF CORRECTION

PATENT NO. : 4,593,229

DATED : June 3, 1986

INVENTOR(S) : Arthur F. McDonie
Donald B. Kaiser

It is certified that error appears in the above-identified patent and that said Letters Patent is hereby corrected as shown below:

| | | |
|---|---|---|
| Column 3, line 37 | - | "along-one" should be --along one--; |
| Column 3, line 49 | - | "base, portion" should be --base portion--; |
| Column 4, line 66 | - | "surfaes" should be --surfaces--. |

Signed and Sealed this

*Nineteenth* Day of *August 1986*

[SEAL]

*Attest:*

DONALD J. QUIGG

*Attesting Officer*

*Commissioner of Patents and Trademarks*